US007841556B2

(12) United States Patent
Elliott et al.

(10) Patent No.: US 7,841,556 B2
(45) Date of Patent: Nov. 30, 2010

(54) SYSTEM AND METHOD FOR DISPENSING PAPER TOWEL

(75) Inventors: Adam Elliott, Lexington, KY (US); Matt Rommel, Independence, KY (US); Dan Paisley, Lexington, KY (US); Howard Carter, Frankfort, KY (US)

(73) Assignee: Wausau Paper Towel & Tissue, LLC, Mosinee, WI (US)

( * ) Notice: Subject to any disclaimer, the term of this patent is extended or adjusted under 35 U.S.C. 154(b) by 881 days.

(21) Appl. No.: 11/562,297

(22) Filed: Nov. 21, 2006

(65) Prior Publication Data

US 2008/0116314 A1 May 22, 2008

(51) Int. Cl.
*B65H 16/10* (2006.01)

(52) U.S. Cl. ..... 242/564.2; 242/565

(58) Field of Classification Search ..... 242/579, 242/580, 560, 560.1, 564, 564.1, 564.2, 564.4, 242/565; D6/521–523; 312/34.11, 34.12; 83/649, 650; 225/10–16, 39, 46, 47
See application file for complete search history.

(56) References Cited

U.S. PATENT DOCUMENTS

| | | | | | |
|---|---|---|---|---|---|
| 454,317 | A | | 6/1891 | Wheeler | |
| 2,470,187 | A | * | 5/1949 | Price | 312/34.11 |
| 2,930,664 | A | | 3/1960 | Liebisch | |
| 3,007,650 | A | * | 11/1961 | Burton | 242/560.1 |
| 3,147,051 | A | * | 9/1964 | Birr et al. | 312/34.24 |
| 3,167,368 | A | | 1/1965 | Rozlog et al. | |
| 3,210,139 | A | | 10/1965 | Ciervo | |
| 3,222,112 | A | * | 12/1965 | Bahnsen | 312/34.12 |
| 3,288,387 | A | | 11/1966 | Craven, Jr. | |
| 3,575,328 | A | | 4/1971 | Jespersen et al. | |
| 4,010,988 | A | * | 3/1977 | Schwartz | 312/34.12 |
| 4,137,805 | A | | 2/1979 | DeLuca et al. | |
| 4,203,562 | A | | 5/1980 | DeLuca et al. | |
| 4,307,639 | A | | 12/1981 | DeLuca | |
| 4,378,912 | A | | 4/1983 | Perrin et al. | |
| 4,404,880 | A | | 9/1983 | DeLuca | |
| 4,408,811 | A | | 10/1983 | Richardson et al. | |
| 4,425,012 | A | | 1/1984 | Kley | |
| 4,487,375 | A | | 12/1984 | Rasmussen et al. | |
| 4,487,385 | A | | 12/1984 | Salmon | |
| 4,635,837 | A | | 1/1987 | Granger | |
| 4,712,461 | A | | 12/1987 | Rasmussen | |
| 4,756,485 | A | | 7/1988 | Bastian et al. | |
| 5,048,386 | A | | 9/1991 | DeLuca et al. | |
| 5,058,792 | A | | 10/1991 | Morand | |
| 5,154,496 | A | | 10/1992 | Campbell et al. | |
| D332,196 | S | * | 1/1993 | Hines | D6/522 |
| 5,400,982 | A | | 3/1995 | Collins | |

(Continued)

FOREIGN PATENT DOCUMENTS

EP 0 209 304 A1 1/1987

(Continued)

*Primary Examiner*—William A Rivera
(74) *Attorney, Agent, or Firm*—Merchant & Gould P.C.

(57) ABSTRACT

A paper towel dispenser is sized to fit within an existing recessed cabinet. The dispenser includes a frame, a pair of roll supports, and a dispensing mechanism. The pair of roll supports are supported by the frame to provide support to a roll of paper towel. The dispenser is also supported by the frame, and operates to dispense the paper towel.

26 Claims, 9 Drawing Sheets

U.S. PATENT DOCUMENTS

| | | | | |
|---|---|---|---|---|
| 5,772,291 | A | 6/1998 | Byrd et al. | |
| 5,924,617 | A * | 7/1999 | LaCount et al. | 242/560.1 |
| 5,979,821 | A * | 11/1999 | LaCount et al. | 242/560.1 |
| 6,006,642 | A | 12/1999 | Granger | |
| 6,098,917 | A * | 8/2000 | Cruz | 242/564.1 |
| 6,105,898 | A | 8/2000 | Byrd et al. | |
| 6,152,397 | A | 11/2000 | Purcell | |
| 6,224,010 | B1 * | 5/2001 | Morand | 242/564.4 |
| 6,250,530 | B1 | 6/2001 | LaCount et al. | |
| 6,314,850 | B1 | 11/2001 | Morand | |
| 6,460,798 | B1 | 10/2002 | Haen et al. | |
| 6,554,158 | B2 | 4/2003 | Kapiloff et al. | |
| 6,581,500 | B1 | 6/2003 | Kietaibl | |
| 6,591,727 | B1 * | 7/2003 | Purcell et al. | 83/650 |
| 6,644,155 | B2 | 11/2003 | Phelps et al. | |
| 6,826,985 | B2 | 12/2004 | Broehl | |
| 7,014,140 | B2 | 3/2006 | Elliott et al. | |
| 7,083,138 | B2 | 8/2006 | Elliott et al. | |
| 7,107,888 | B2 | 9/2006 | Blume et al. | |
| 7,114,676 | B2 | 10/2006 | Elliott et al. | |
| 7,127,974 | B2 | 10/2006 | Blume et al. | |
| 2005/0051005 | A1 | 3/2005 | Broehl | |
| 2005/0167543 | A1 | 8/2005 | Elliott et al. | |

FOREIGN PATENT DOCUMENTS

| | | | |
|---|---|---|---|
| WO | WO 2007/011747 | A2 | 1/2007 |

* cited by examiner

SYSTEM AND METHOD FOR DISPENSING PAPER TOWEL

TECHNICAL FIELD

This disclosure relates to a system and method for dispensing paper towel, and more particularly to a system and method for dispensing paper towel from a recessed cabinet.

BACKGROUND

Paper towels are commonly used for a variety of purposes, such as for drying a person's hands after they have been washed. One common paper towel dispenser includes an upper cabinet that holds pre-folded paper towels and a lower cabinet for storing used paper towels prior to their disposal. The upper cabinet includes a bottom plate having an elongated hole where paper towels can be removed manually from the cabinet. Typically this type of paper towel dispenser is completely recessed into a wall structure, such as a restroom wall in the vicinity of a restroom sink.

This type of paper towel dispenser has a number of disadvantages. One disadvantage with these dispensers is that pre-folded paper towel is relatively expensive, because it must be pre-cut to the desired length, folded, and packaged, all of which adds to manufacturing costs as compared to rolled paper towel. Another disadvantage is that these dispensers will sometimes dispense more than one sheet of pre-folded paper towel at a time, whether the user intended to take more than one sheet or not. Either way, the additional paper results in greater amounts of waste. The pre-folded paper design increases the amount of waste because the paper is often not fully unfolded before use. As a result, more towels are often taken by a user than would be necessary if the paper towels were each fully unfolded.

An associated concern with multiple towels that are often dispensed at once is the problem of clogging. When a user grasps a towel, the towel will become wet and may tear when the user attempts to pull it out. The combination of tearing towels and multiple towels being pulled out sometimes leads to clogging of the dispenser, making it difficult to remove a towel and also resulting in more waste. Another factor that leads to clogging is the amount of folded paper towel stacked in the upper cabinet. The greater the stack size, the greater the downward forces applied that press the bottom-most towel against the bottom plate, which makes it more difficult to remove the towel without tearing.

Attempts have been made to solve these problems with existing recessed paper towel dispensers (e.g. those that dispense individually cut and folded paper towels) by retrofitting existing paper towel dispensers with paper towel dispensers that utilize paper towel rolls. These attempts have themselves caused certain disadvantages. Retrofitting an existing paper towel dispenser requires that significant modifications to the existing cabinet be made. Typical wall mounted paper towel dispensers use covers or housings as well as large paper towel rolls (e.g., 7.5 inches to 10 inches in diameter and 7.5 inches to 10 inches in width) that are too wide and too large in diameter to fit within the existing cabinet completely. As a result, the cabinet door must be removed to allow the dispenser to extend out from the cabinet. In addition, the bottom plate must also be removed so as to not interfere with the bottom of the dispenser, and the dispensing of the rolled paper. Finally, additional trim pieces are typically required to cover the edges between the recessed cabinet and the cover or housing of the rolled paper towel dispenser.

SUMMARY OF THE DISCLOSURE

A paper towel dispenser is disclosed that is adapted for use in an existing paper towel dispenser that is configured to dispense individually pre-cut and pre-folded paper towels and is recessed within a wall structure. The existing paper towel dispenser includes an upper cabinet defining a cavity for holding folded paper towel products. The upper cabinet has a cabinet door that, when closed, is substantially coplanar with the planar exposed surface of the wall structure.

The paper towel dispenser is configured to fit within the cavity of the upper cabinet. The paper towel dispenser includes a frame, a pair of paper roll supports, and a dispensing mechanism. The pair of paper roll supports are supported by opposite sides of the frame and are used to support a roll of paper towel. The dispensing mechanism engages the free end of the towel to advance the paper towel out of the upper cabinet.

There is no requirement that an arrangement, system, or method disclosed herein include all features characterized herein to obtain some advantage according to this disclosure.

DETAILED DESCRIPTION

A paper towel dispenser is described that can be installed within a recessed space in a wall. For example, one application of the paper towel dispenser described below is to be installed within an existing recessed cabinet, such as those designed for the manual dispensing of individual pre-cut and pre-folded paper towels. It is often desirable to dispense paper towel from paper towel rolls, rather than the pre-folded and pre-cut paper towels. Typical paper towel dispensers that dispense paper towels from paper towel rolls, however, are too large to fit within the existing recessed cabinet. Therefore, the paper towel dispenser described below, which is sized to fit within the recessed cabinet, effectively solves this and other problems.

The paper towel dispenser described below, is not limited to being installed in existing cabinets. Most any appropriately sized recessed space within a wall or other structure will permit the installation of the paper towel dispenser.

Furthermore, the paper towel dispensers disclosed herein can be used outside of a recessed space. Such applications outside of a recessed space will require an additional housing or cover sized to cover at least some of the operating portions of the paper towel dispenser. The paper towel dispenser can be considered a "low profile" dispenser" in that the depth dimension is relatively small compared to paper towel dispensers configured to dispense large rolls of paper towel (e.g., rolls with diameter of 7.5 inches to 10.0 inches).

The paper towel dispenser can be used to dispense paper towels from one or more rolls of paper towel. For example, two paper towel rolls can be dispensed from the paper towel dispenser, as described in more detail below. When two or more rolls of paper towel are to be dispensed from the paper towel dispenser, a transfer mechanism is used to deliver a new roll of paper towel to the dispensing mechanism, after the other roll of paper towel has been depleted.

The paper towel dispenser includes a manual actuator that is located within the recessed space of the wall and enables a user to manually actuate the paper towel dispenser to dispense lengths of paper towel. For example, the manual actuator can extend vertically downward from the paper towel dispenser, behind the location where paper towels are dispensed. Alternatively, manual actuator can be located to the side, or behind and to the side, of the location where paper towels are dispensed. The manual actuator can be used either as an emergency feed mechanism, such that it is only used when paper fails to automatically feed partially or fully from the dispenser, or as the primary feed mechanism, such that it is always used to feed paper towel from the dispenser.

Figure 1:
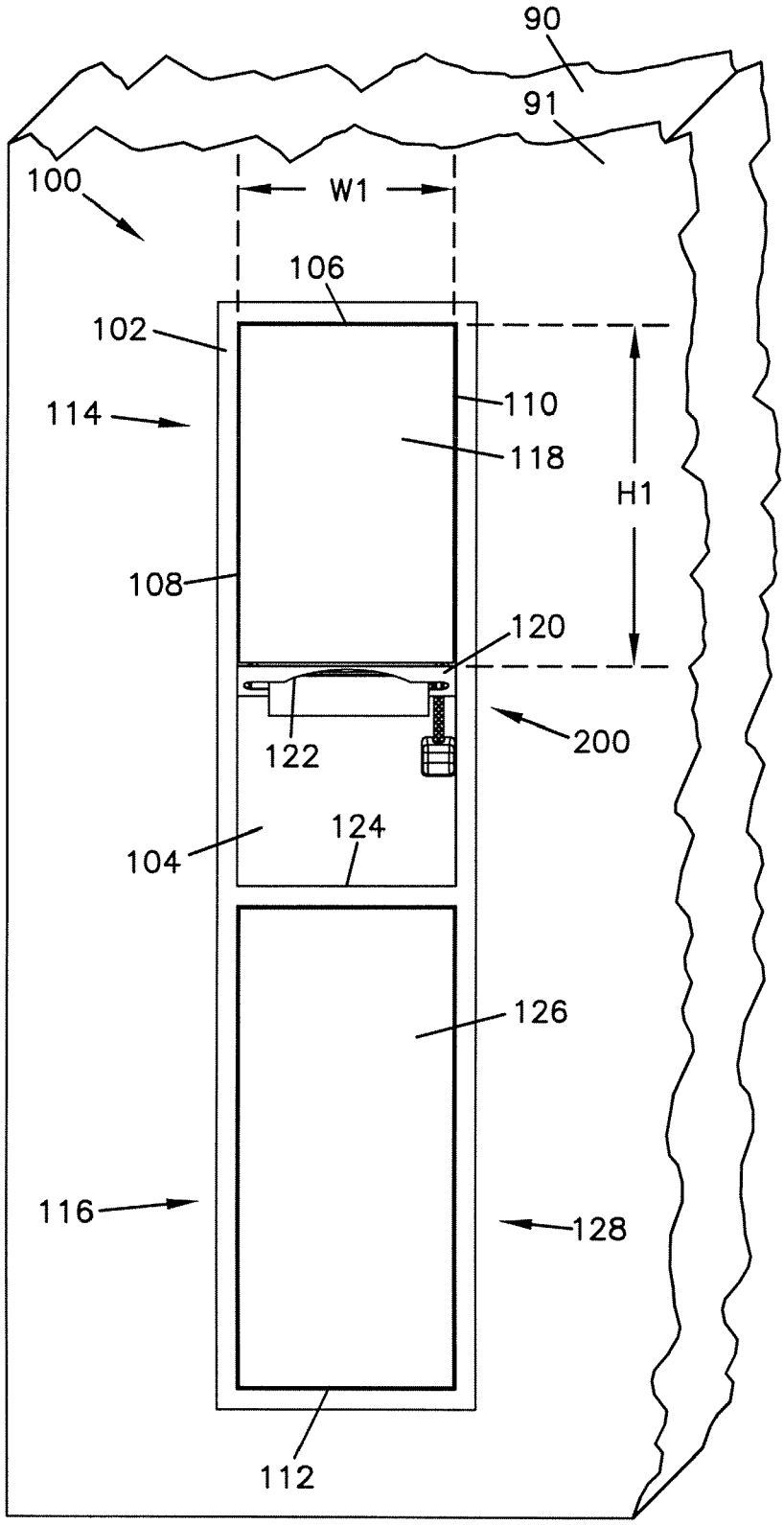
FIG. 1 is a front view of a cabinet recessed within a wall and having an example of a paper towel dispenser according to the present disclosure mounted therein.

FIG. 1 is a front view of cabinet 100 positioned within a recessed space 92 (see FIG. 3) in wall 90 and having an example of paper towel dispenser 200 mounted within an enclosed cavity of cabinet 100. The recessed space 92 is sized to retain substantially all of the cabinet 100 within wall 90. Cabinet 100 includes face trim 102 and a plurality of panels: back panel 104, top panel 106, left side panel 108, right side panel 110, and bottom panel 112. Cabinet 100 also includes upper cabinet 114 and lower cabinet 116. Upper cabinet 112 includes cabinet door 118 and bottom plate 120 having towel opening 122. Lower cabinet 114 includes opening 124, cabinet door 126, and storage region 128.

Figure 3:
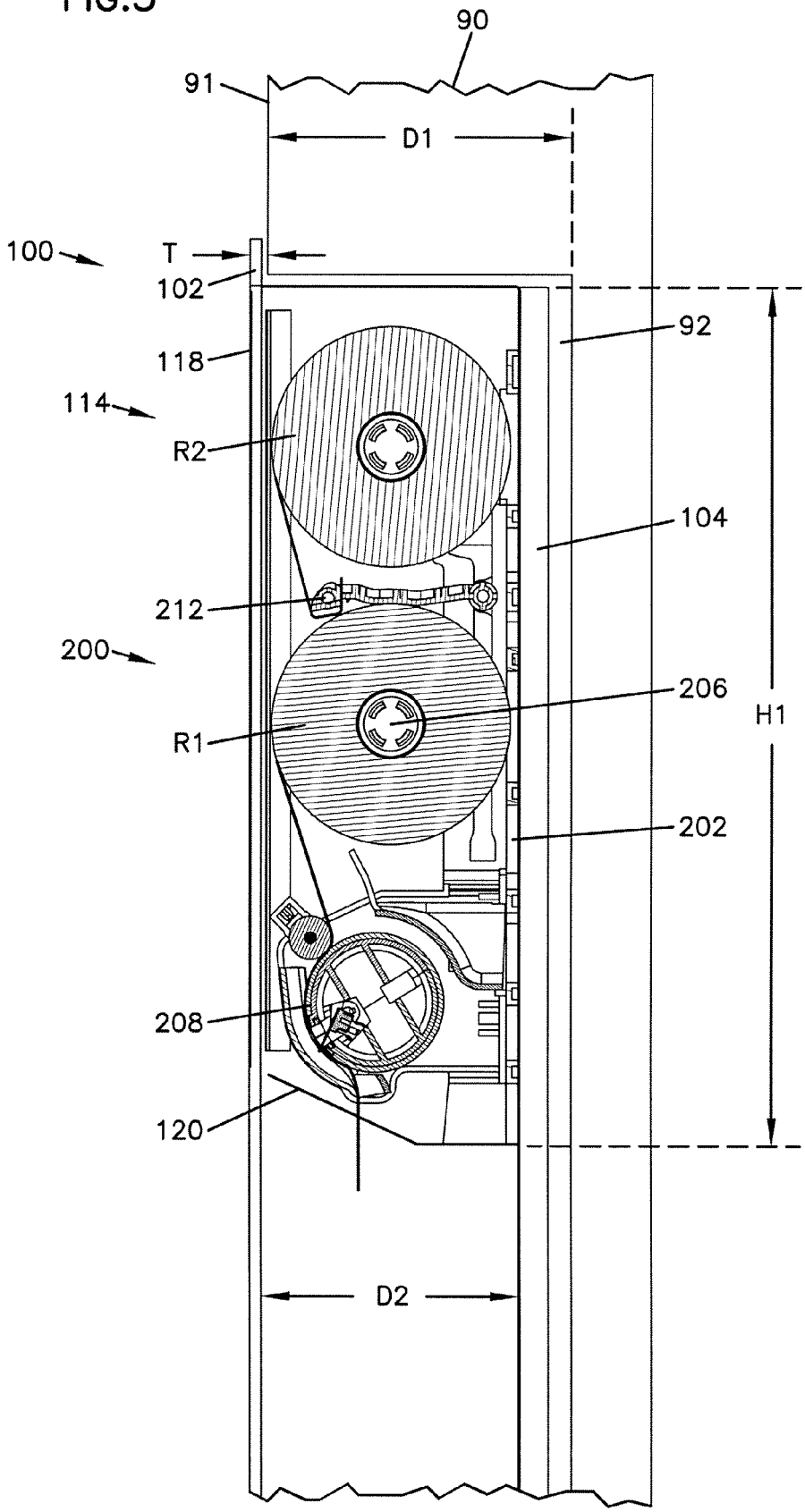
FIG. 3 is a right side cross sectional view of the cabinet and paper towel dispenser of FIG. 1.

Face trim 102 extends around the outer edges of cabinet 100, covering any gap that may exist between cabinet 100 and portions of wall 90 that define recessed space 92. Face trim 102 engages planar exposed surface 91 of wall 90, such that face trim 102 is substantially coplanar with wall 90. Face trim 102 is forward from planar exposed surface 91 of wall 90 by a thickness T of the material of face trim 102 (such as shown in FIG. 3).

For purposes of this disclosure, the phrase substantially coplanar with wall 90 means that a plane of the surface described is near to planar exposed surface 91 of the wall, but separated by about the thickness of the material located adjacent the planar exposed surface, and any space required by fasteners, such as adhesive, screws, or brackets. For example, in FIG. 1 the exposed surfaces of face trim 102 and cabinet door 118 are all aligned within the same plane. This plane is substantially coplanar with planar exposed surface 91 of wall 90, spaced by the thickness of face trim 102 and any space needed for fastening face trim 102 to planar exposed surface 91, such as the thickness of an adhesive layer. For example, the plane of face trim 102 and cabinet door 118 may be offset from the plane of the wall by less than about one inch, and preferably less than about one-half of an inch. In addition, substantially coplanar with wall 90 also includes a plane that is near to planar exposed surface 91 of wall 90, but is recessed into wall 90 from planar exposed surface 91.

Top and bottom panels 106 and 112 are generally horizontally oriented and are connected at opposite ends to left and right side panels 110. Left side panel 108 and right side panel 110 are generally vertically oriented. Top panel 106, bottom panel 112, left side panel 108, and right side panel 110 are all connected to back panel 104. Back panel 104 extends vertically across the entire back side of recessed cabinet 100.

Upper cabinet 112 is the region of recessed cabinet 100 formed by upper portions of left side panel 108 and right side panel 110, by top panel 106 and bottom plate 120, and by upper portions of back panel 104 and cabinet door 118. Upper cabinet 114 has interior width W1 and interior height H1. For example, width W1 is in a range from about 8 inches to about 12 inches, and height H1 is in a range from about 16 inches to about 24 inches.

Cabinet door 118, when closed, is coplanar with face trim 102, and substantially coplanar with wall 90. Upper cabinet 112 is designed to hold a stack of folded paper towels such as, for example, a stack of three-fold individually cut paper towels. The folded paper towels can be removed through towel opening 122.

Lower cabinet 116 is the region of recessed cabinet 100 formed by lower portions of left side panel 108, right side panel 110, opening 124, bottom panel 112, a lower portion of back panel 104, and cabinet door 126. Cabinet door 126, when closed, is coplanar with face trim 102, and substantially coplanar with wall 90. Lower cabinet 116 is designed to be a receptacle for used towels, which are stored within storage region 126.

Dispenser 200 is located within upper cabinet 112 of recessed cabinet 100. Dispenser 200 is sized and shaped such that it fits entirely within recessed space 92 and primarily within upper cabinet 112 behind cabinet door 118 when cabinet door 118 is in the closed position shown in FIG. 1. A manual actuator 202 of dispenser 200 extends downward from upper cabinet 114, and through bottom plate 122. In operation, dispenser 200 dispenses lengths of paper towel through towel opening 122. The lengths of towel are removed by a user and used as desired. The used towel can then be disposed of into storage region 128 of lower cabinet 116.

Cabinet doors 118 and 126 enable a user or maintenance person to have access within recessed cabinet 100. Cabinet door 118 can be pivotally connected to either left side panel 108 or right side panel 110, enabling cabinet door 118 to be opened and closed. Cabinet door 118 is opened to install dispenser 200, to refill dispenser 200 with paper towel rolls, or for repair or maintenance. After the desired task has been completed, cabinet door 118 is closed, such that it is substantially coplanar with wall 90.

Figure 2:
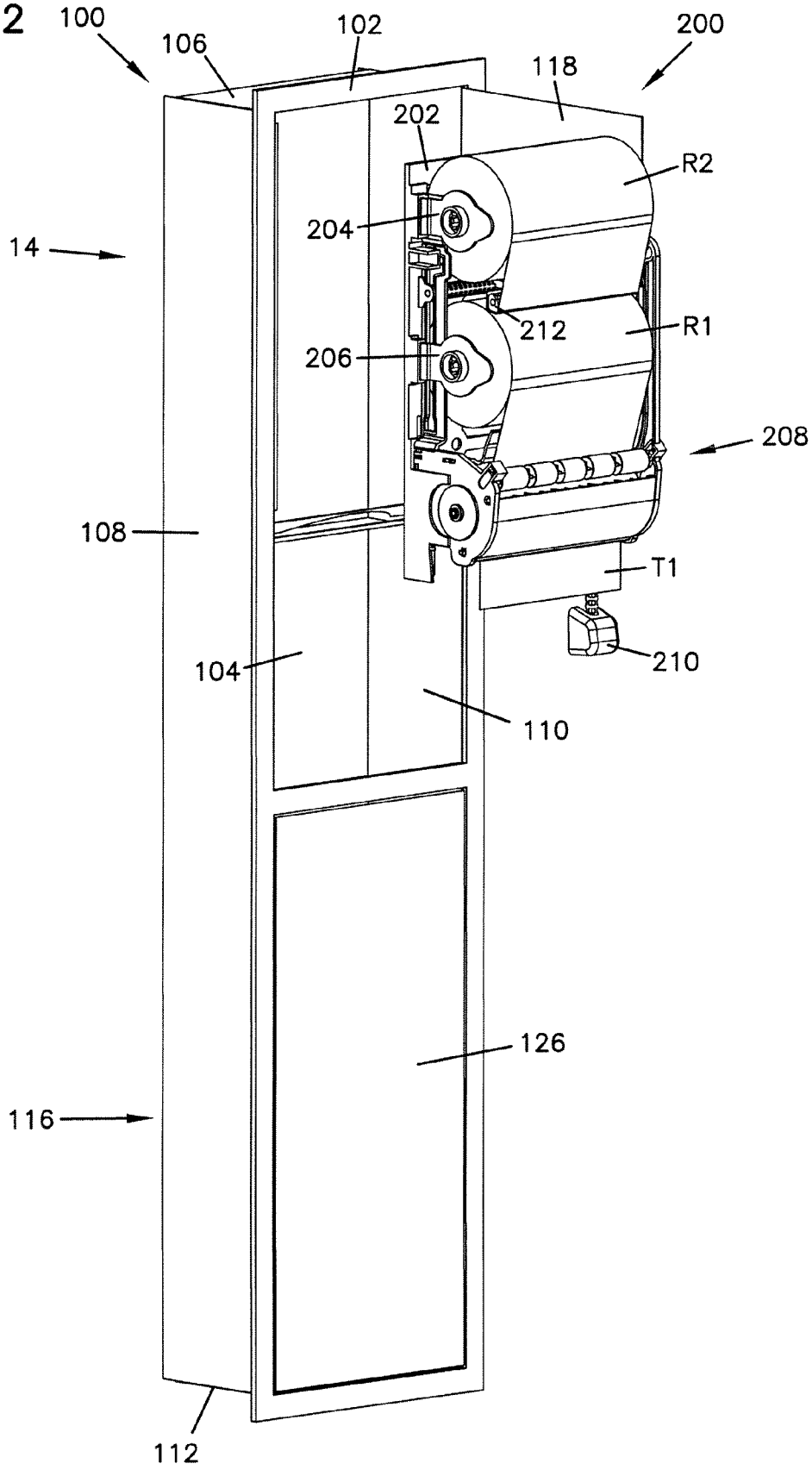
FIG. 2 is a partially exploded perspective view of the cabinet and paper towel dispenser of FIG. 1 with an upper cabinet door in an open position.
Figure 5:
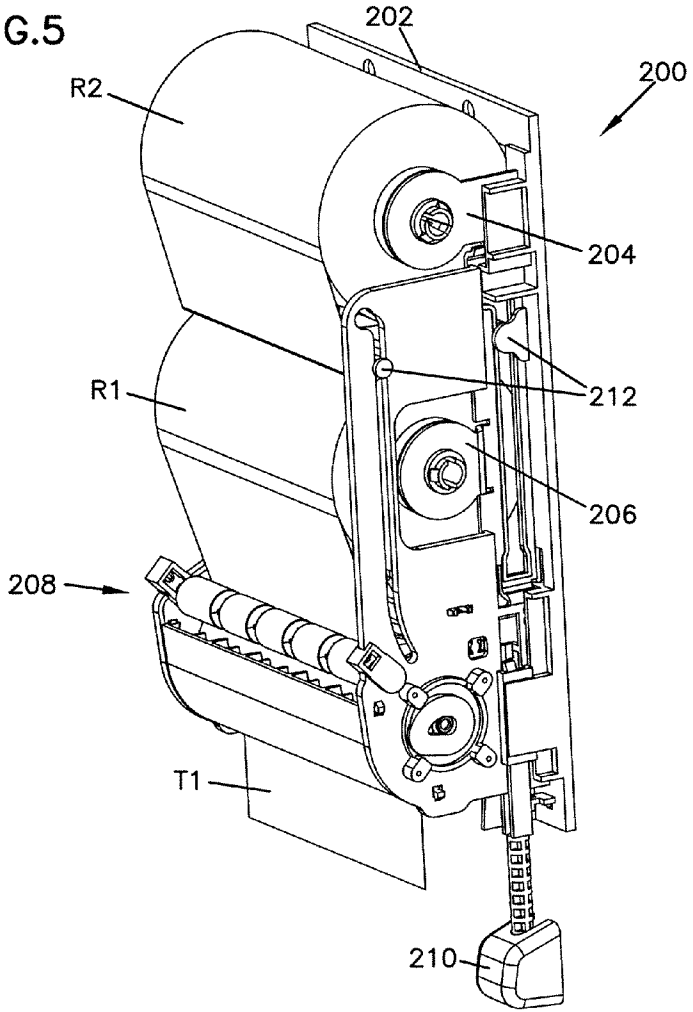
FIG. 5 is a right perspective view of the paper towel dispenser of FIG. 1 with the main towel roll fed through the dispensing mechanism.
Figure 4:
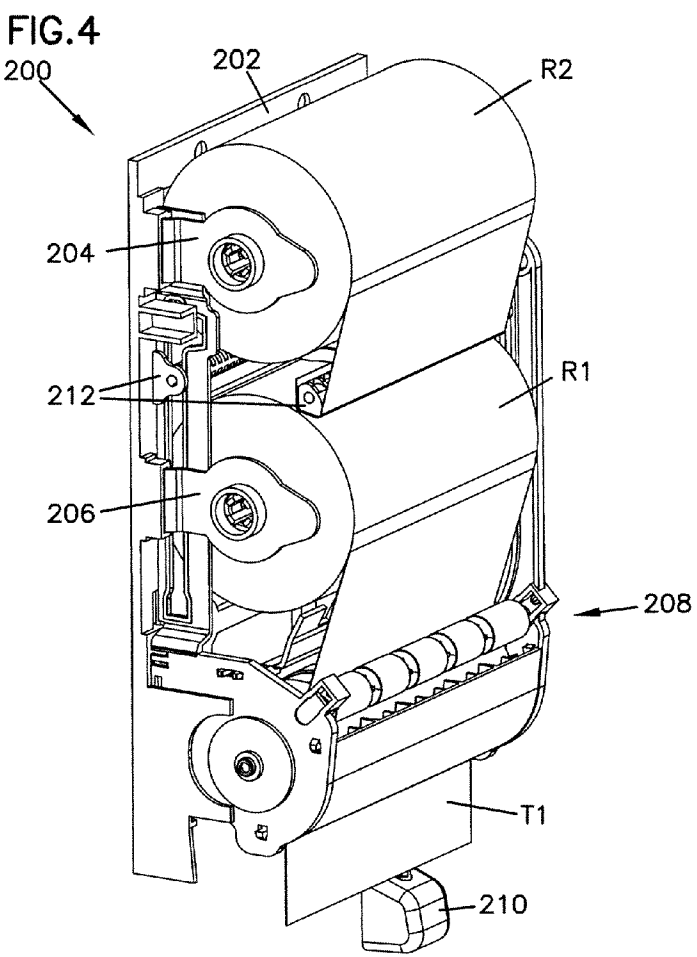
FIG. 4 is a left perspective view of the paper towel dispenser of FIG. 1 with a main towel roll fed through the dispensing mechanism.

A general overview of the parts of dispenser 200 will now be described with reference to FIGS. 2-5. FIG. 2 is a perspective view of recessed cabinet 100 and dispenser 200, where dispenser 200 is exploded from recessed cabinet 100. FIG. 3 is a side cross sectional view of wall 90, cabinet 100, and dispenser 200. FIGS. 4 and 5 are perspective views of dispenser 200. Recessed cabinet 100 includes top panel 106, left side panel 108, right side panel 110, bottom panel 112, upper cabinet 114, and lower cabinet 116. Upper cabinet 114 includes cabinet door 118 and bottom plate 120. Lower cabinet 116 includes cabinet door 126.

Dispenser 200 includes frame 202, roll supports 204 and 206, dispensing mechanism 208, manual actuator 210, and transfer mechanism 212. Dispenser 200 contains towel rolls including main towel roll R1 and secondary towel roll R2. Dispenser 200 dispenses and cuts towel from towel rolls R1 and R2 to dispense lengths of towel T1 and T2, respectively.

Frame 202 provides the rear structural support for dispenser 200. Roll supports 204 and 206 are supported by frame 202 and are designed to support towel rolls R1 and R2, while also enabling towel rolls R1 and R2 to rotate to dispense lengths of towel T1 and T2. In the illustrated example of dispenser 200, two towel rolls R1 and R2 can be contained, but it is recognized that other examples may contain any number of towel rolls. Main roll R1 is the first roll that is dispensed, as shown. Transfer mechanism 212 is connected to towel roll R2 at the free end, and rests on top of main towel roll R1 until main towel roll R1 has been dispensed. The dispenser 200 is fastened to cabinet 100 via frame 202. For example, frame 202 can be screwed, riveted, glued, bolted, taped, or connected with brackets to back panel 104.

FIG. 3 illustrates dimensions of upper cabinet 114 of recessed cabinet 100. Recessed space 92 within wall 90 has depth D1. Upper cabinet 114 fits within recessed space 92, and has interior depth D2 and height H1. Depth D1 of recessed space 92 is greater than interior depth D2 of upper cabinet 114. Dispenser 200 fits within upper cabinet 114, and therefore has dimensions less than the interior space of upper cabinet 114. The outer surface of recessed cabinet 100 is substantially coplanar with planar exposed surface 91, being spaced from planar exposed surface 91 by thickness T, the thickness of face trim 102.

Dispenser 200 does not have to be installed within a recessed cabinet, but rather can be mounted within any recessed space (e.g., 92 shown in FIG. 3) in a wall or other structure. There is no requirement that a recessed cabinet be installed prior to the mounting of dispenser 200 within a recessed space. For example, if dispenser 200 is mounted to wall 90 within recess 92, a separate housing cover or cabinet door can be installed substantially coplanar with planar exposed surface 91 of wall 90. Alternatively, an entire housing or cabinet can be formed around dispenser 200, being connected to frame 202, the dispenser 200 and housing then being installed within recessed space 92, such that the outer surface of the housing or cabinet is substantially coplanar with surface 91 of wall 90.

Figure 7:
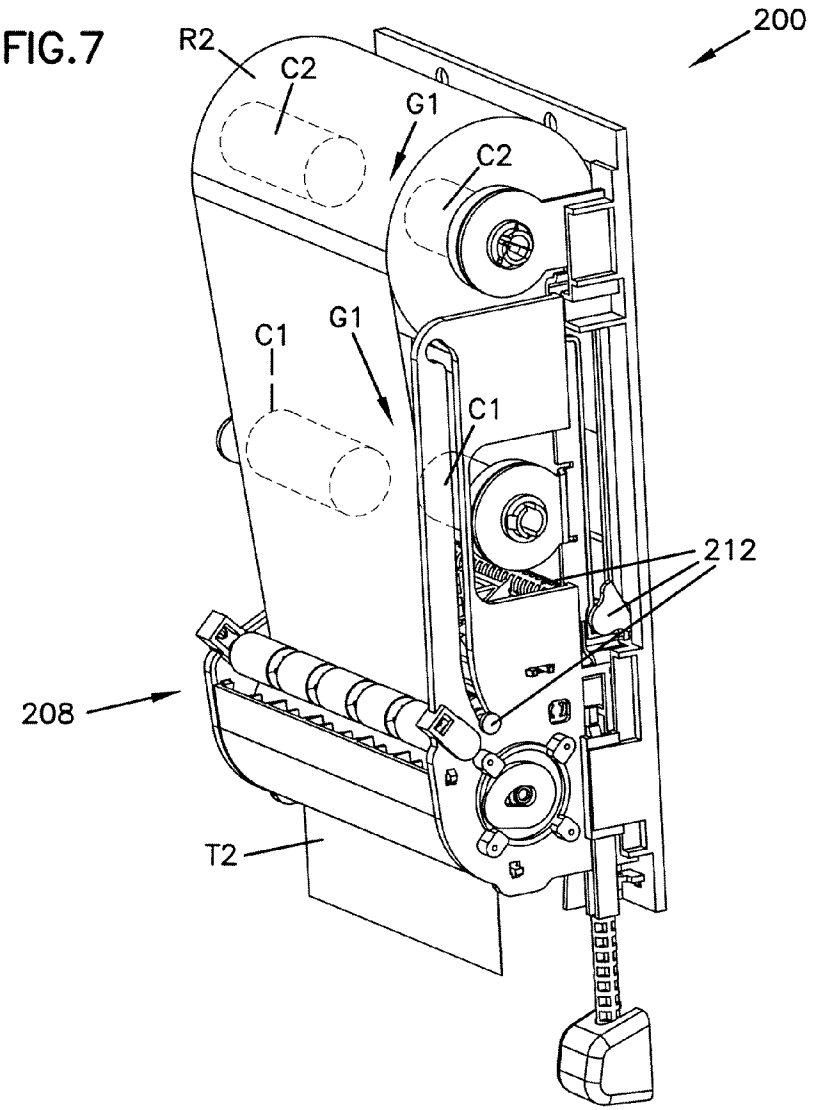
FIG. 7 is a right perspective view of the paper towel dispenser of FIG. 1 with the main towel roll depleted and the secondary towel roll fed through the dispensing mechanism.
Figure 6:
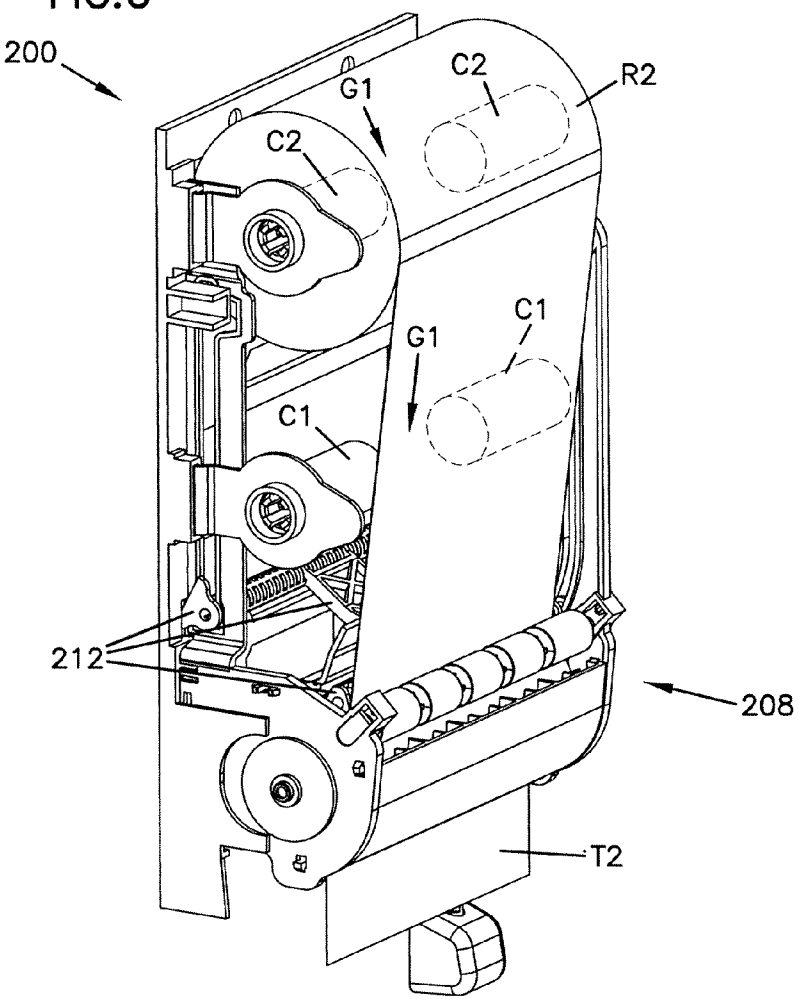
FIG. 6 is a left perspective view of the paper towel dispenser of FIG. 1 with the main towel roll depleted and a secondary towel roll fed through the dispensing mechanism.

FIGS. 6 and 7 are perspective views of dispenser 200 after main towel roll R1 has been completely dispensed, and secondary towel roll R2 is in position to be dispensed.

Towel rolls R1 and R2 include a reduced core structure having separate members C1 and C2, such as two spaced cylinders of cardboard around which the paper towel material is rolled. Example methods and apparatuses for generating reduced core paper rolls are disclosed in U.S. Pat. Nos. 7,107,888 and 7,127,974, which are incorporated herein by reference. Cores C1 and C2 include two cylindrical members that are aligned along a central axis and separated from each other by gaps G1 and G2, respectively. The reduced core rolled towel has the benefit of reducing the waste generated by discarded cores, and also reducing the amount of material needed to make the core, thereby reducing the cost of manufacture. Other advantages of using reduced core paper towel are also realized with respect to the operation of transfer mechanism 212 that will now be described.

When all of the paper from main roll R1 has been dispensed, gap G1 of towel roll R1 is exposed. This gap is aligned with a central region of transfer mechanism 212, the same region that rests on top of main roll R1. Once gap G1 is exposed, transfer mechanism 212 is pulled, such as by gravity, in a downward direction through gap G1 between members C1. Alternatively, a weight or springs can be used to pull transfer 212 in a downward direction. Transfer mechanism 212 thereby applies a downward force to the free end of secondary towel roll R2. The downward force causes towel roll R2 to rotate and advance the free end of towel roll R2 toward dispensing mechanism 208. Transfer mechanism 212 continues advancing the free end of towel roll R2 until the free end is positioned adjacent to dispensing mechanism 208. Dispensing mechanism 208 then engages the free end of secondary towel roll R2 to begin dispensing lengths of towel T2. In this way, transfer bar 212 enables dispenser 200 to dispense twice as much paper towel as if only a single roll were used. This enables the dispenser to be refilled less often, saving maintenance time and expense.

Figure 8:
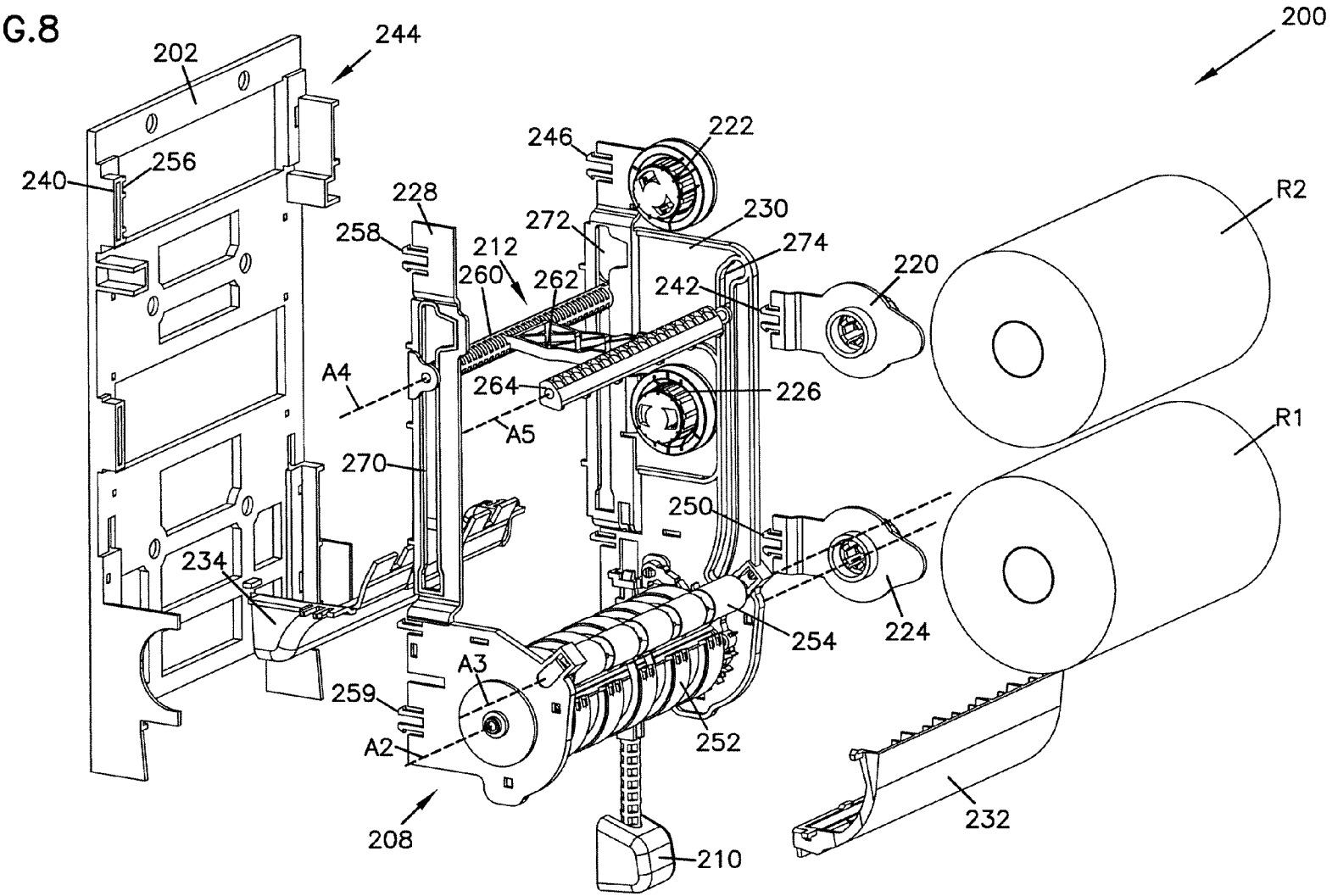
FIG. 8 is a right exploded perspective view of the paper towel dispenser of FIG. 1 with the main and secondary towel rolls.

FIG. 8 is an exploded perspective view of dispenser 200 and towel rolls R1 and R2. Dispenser 200 includes frame 202; roll supports 220, 222, 224, 226; dispensing mechanism 208; manual actuator 210; transfer mechanism 212; side plates 228 and 230; towel guide 232; and stray core receptacle 234.

Roll supports 220, 222, 224, 226 support towel rolls R1 and R2 within dispenser 220, such that a central axis of towel rolls R1 and R2 have a horizontal orientation. Roll supports 220 and 222 support opposite sides of towel roll R2. Roll support 220 is connected to slot 240 of frame 202 by a fastener such as spring tabs 242. Roll support 222 is connected to side plate 230, both of which are connected to slot 244 of frame 202 by a fastener such as spring tabs 246. Roll supports 224 and 226 support opposite sides of towel roll R1. Roll support 224 is connected to slot 248 of frame 202 by a fastener such as spring tabs 250. Roll support 226 is connected to side plate 230, which is connected to frame 202 by spring tabs 246.

Dispensing mechanism 208 includes drum 252 and pinch roller 254. Drum 252 is rotationally connected at each end to side plate 228 and side plate 230, and oriented with horizontal central axis A2. Drum 252 is overmolded with rubber or other materials having a high coefficient of friction to frictionally engage a free end of towel roll R1 or R2. Pinch roller 254 is rotationally and slidably connected at each end to side plate 228 and side plate 230, and oriented with horizontal central axis A3. Pinch roller 254 can be made, for example, having a steel shaft surrounded by a plastic material. An alternative is to coat the plastic material with rubber or other materials having a high coefficient of friction. Pinch roller 254 also includes springs at each end of pinch roller 254 to apply a force on pinch roller 254 toward drum 252 to engage the free end of towel roll R1 or R2 between pinch roller 254 and drum 252. Dispensing mechanism 208 can be powered by electric motors or powered manually by the user. Example dispensing mechanisms for dispensing and cutting paper towel from paper towel rolls are disclosed in U.S. Pat. Nos. 4,712,461, 6,314,850, and 6,581,500, which are incorporated herein by reference. Dispensing mechanism 208 is partially surrounded by towel guide 232 that guides the free end of towel roll R1 or R2 around drum 252 and out of dispenser 200.

Manual actuator 210 is slidably connected to side plate 230, and extends vertically down from side plate 230, below dispensing mechanism 208. Manual actuator 210, described in more detail below, enables an operator to manually advance dispensing mechanism 208 to dispense lengths of towel.

Transfer mechanism 212 includes rear member 260, cross member 262, and towel engagement member 264. Rear member 260 and towel engagement member 264 each have central axes, A4 and A5 respectively, which are horizontally oriented and substantially parallel to each other. Cross member 262 is connected at one end to a central portion of rear member 260 and at the other end to a central portion of towel engagement member 264, and is oriented generally perpendicular to rear member 260 and towel engagement member 264. Towel engagement member 264 includes barbs on a bottom or rear side onto which a free end of towel roll R2 can be temporarily engaged. The free end of towel roll R2 is held by towel engagement member 264 until transfer mechanism 212 has delivered the free end of towel roll R2 to dispensing mechanism 208, at which time dispensing mechanism 208 engages the free end of towel roll R2 and removes it from towel engagement member 264, for dispensing out of dispenser 200.

Side plate 230 includes rear track 270 that extends generally vertically within side plate 228. Side plate 228 is connected at one end to slot 256 of frame 202 by a fastener, such as spring tabs 258. The opposite end of side plate 228 is similarly connected to a lower portion of frame 202 by spring tabs 259. One end of rear member 260 is slidably connected to rear track 270.

Side plate 230 includes rear track 272 and front track 274. The end of rear member 260, opposite the connection to rear track 270, is slidably connected to rear track 272. One end of towel engagement member 264 is slidably connected to front track 274. Tracks 270, 272, and 274 together guide transfer mechanism 212 in a generally straight and vertically downward path toward dispensing mechanism 208. During replacement of towel roll R1, transfer mechanism 212 is manually raised to the top of tracks 270, 272, and 274 until towel roll R1 has been properly inserted.

Side plate 230 also includes an enlarged forward jog at the top end of the tracks. This jog enables transfer mechanism 212 to be installed within tracks 270, 272, and 274.

Tracks 270 and 272 both also include an enlarged space at the bottom end of the tracks. The enlarged spaces provide space for rear member 260 to pivot within tracks 270 and 272. A lower portion of track 274 includes a rearward curve. When transfer mechanism 212 slides down tracks 270, 272, and 274, the tracks function together to guide towel engagement member 264 into precise alignment with dispensing mechanism 208, specifically depositing the free end of towel roll R2 adjacent to the space between drum 252 and pinch roller 254. Tracks 270, 272, and 274 cause transfer mechanism 212 to pivot, such that it has a slightly front-down orientation.

Stray core receptacle 234 partially surrounds drum 252 on a side adjacent to pinch roller 254 and opposite towel guide 232. Stray core receptacle 234 catches stray cores from towel role R1 should a core member come disengaged from roll supports 224 or 226 and fall toward dispensing mechanism 208 after the paper towel has been dispensed from towel roll R1. The core members are stored next to frame 202 and on top of stray core receptacle 234 where they will not interfere with the operation of dispensing mechanism 208.

Figure 9:
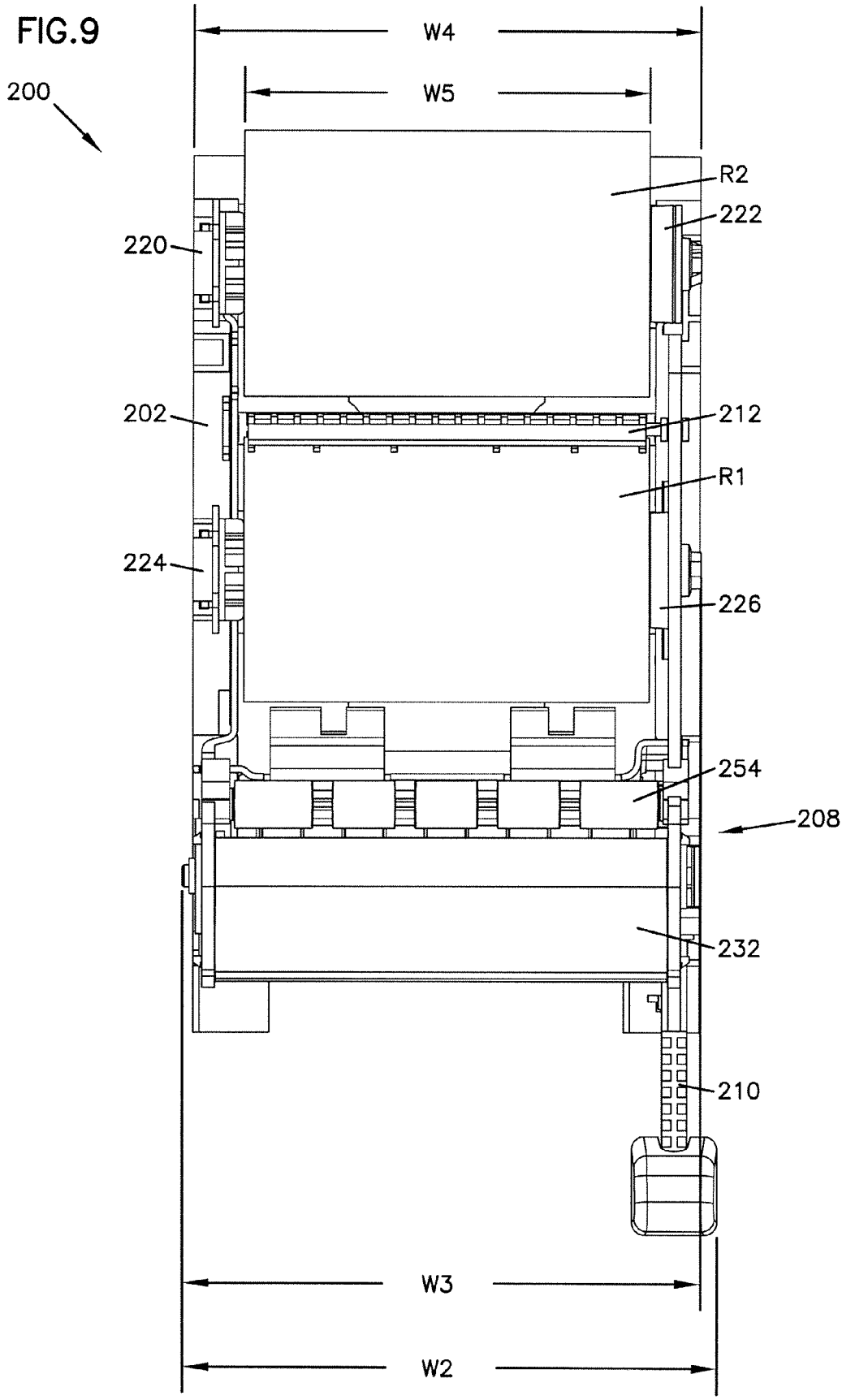
FIG. 9 is a front view of the dispenser of FIG. 1 with the main and secondary towel rolls.
Figure 10:
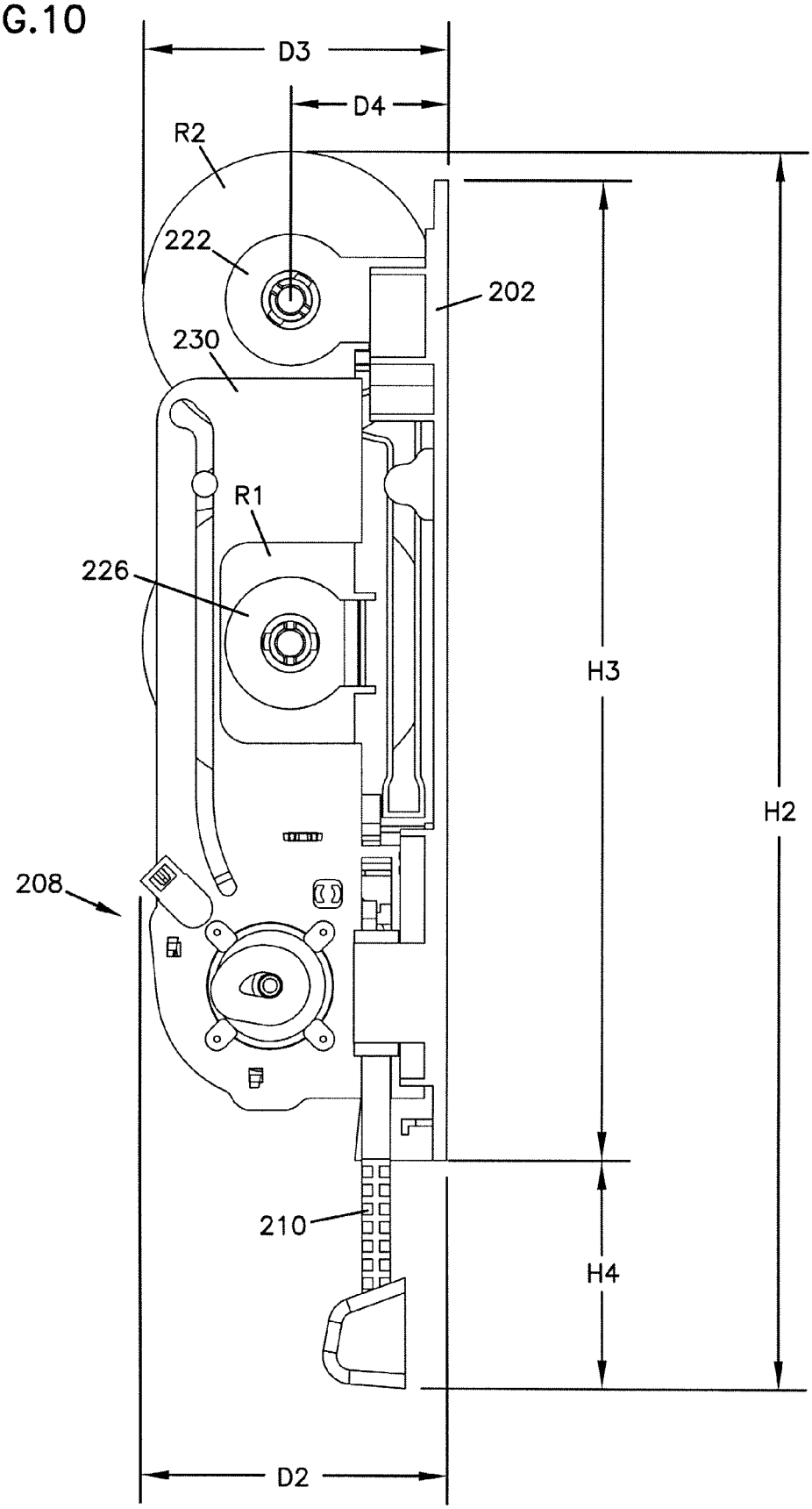
FIG. 10 is a right side view of the dispenser of FIG. 1 with the main and secondary towel rolls.

FIGS. 9-10 are front and side views of dispenser 200, respectively. These views are provided to illustrate dimensions for one example of dispenser 200. It is recognized that a wide variety of recessed cabinet shapes and sizes exist, and that the dispenser of the present disclosure can be sized to fit within any sized recessed cabinet. However, to fully explain one example, the following dimensions are provided for one size and shape of recessed cabinet.

FIG. 9 is a front view of dispenser 200 including frame 202, roll supports 220, 222, 224, 226, dispensing mechanism 208 including pinch roller 254, manual actuator 210, and towel guide 232. The overall width W2 of dispenser 200 is in a range from about 6 inches to about 24 inches, and more particularly from about 8 inches to about 12 inches. Width W2 is measured from one side of dispensing mechanism 208 to the opposite side of manual actuator 210.

Width W3 is the overall width of the portion of dispenser 200 that fits within the upper cabinet (e.g. 114 of FIG. 1), and is also the width of dispensing mechanism 208. Width W3 is shown slightly smaller than width W2, being in a range from about 0.1 inches to about 1 inch smaller than width W2. However, in other examples, the widths W2 and W3 can be substantially the same size.

Width W4 is the overall width of dispenser 200 above dispensing mechanism 208. Width W4 is slightly smaller than width W3, being in a range from about 0.1 inches to about 1 inch smaller than width W3. However, in other examples, the widths W3 and W4 can be substantially the same size.

Width W5 is the width of rolls R1 and R2. Width W5 is in a range from about 6 inches to about 10 inches, and preferably about 7.5 inches.

FIG. 10 is a side view of dispenser 200 including frame 202, dispensing mechanism 208, manual actuator 210, roll supports 222 and 226, and side plate 230. The overall depth D3 of dispenser 200 is in a range from about 4 inches to about 10 inches, and preferably from about 5 inches to about 6 inches. Diameter D4 of towel rolls R1 and R2 is in a range from about 4 to about 10 inches, and preferably from about 4 inches to about 6 inches. Depth D5 is the distance from a central axis of towel rolls R1 and R2 to the back of frame 202, and is a range from about 1 inch to about 5 inches, and preferably from about 2.5 inches to about 3 inches.

The overall height H2 of dispenser 200 is in a range from about 15 inches to about 30 inches, although greater or lesser heights could also be used depending on, for example, the number of rolls carried by the dispenser. Height H2 is preferably in a range from about 18 inches to about 24 inches. Overall height H2 can also vary depending, for example, on the desired length of manual actuator 210.

Height H3 is the height of frame 202 and is in a range from about 14 inches to about 20 inches, and preferably from about 16 inches to about 18 inches.

Height H4 is the length of manual actuator 210 from the bottom of frame 202 to the bottom of manual actuator 210, and is in a range from about 2 inches to about 8 inches, and preferably from about 3 inches to about 5 inches.

The important point with respect to the dimensions of dispenser 200 is that the dispenser is designed to fit within a recessed cabinet or within a recessed space in a wall. As a result, depth D2 of dispenser 200 should be less than depth D2 of the recessed cabinet (shown in FIG. 3). Width W2 and W3 of dispenser 200 should be less than the interior width W1 of upper cabinet 114 (shown in FIG. 1). Height H3 of dispenser 200 should be less than an interior height H1 of upper cabinet 114 (shown in FIG. 1). Dispenser 200 could, therefore, be designed within these or other parameters to fit within any sized recessed cabinet.

Figure 11:
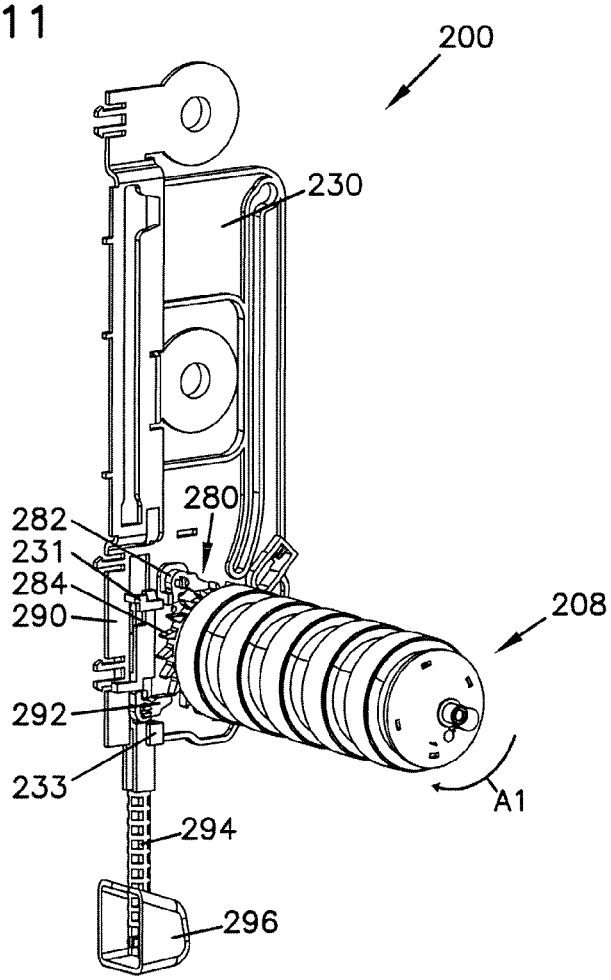
FIG. 11 is a rear perspective view of selected parts of the paper towel dispenser of FIG. 1.

FIG. 11 is a rear perspective view illustrating selected parts of dispenser 200, including dispensing mechanism 208, manual actuator 210, and side plate 230. Dispensing mechanism 208 includes drum 252, cogwheel 280, and anti-reverse mechanism 282. Cogwheel 280 includes a plurality of teeth 284.

Cogwheel 280 is rigidly connected to one side of drum 252 and includes a plurality of teeth 284 that can be used to advance drum 252 and also to prevent drum 252 from rotating backwards. Cogwheel 280 and drum 252 can rotate around a central axis in the direction of arrow A1, but are inhibited from rotation in the direction opposite arrow A1 by anti-reverse mechanism 282. Anti-reverse mechanism 282 is mounted onto side plate 230 adjacent cogwheel 280 and includes a spring that presses anti-reverse mechanism 282 toward cogwheel 280. As cogwheel 280 rotates in the direction of arrow A1, anti-reverse mechanism 282 slides across teeth 284 of cogwheel 280. However, if drum 252 and cogwheel 280 begin to rotate in the direction opposite arrow A1, anti-reverse mechanism 282 catches on one of teeth 284, thereby inhibiting drum 252 and cogwheel 280 from further rotation in that direction.

Manual actuator 210 includes support member 290, arm 292, actuator bar 294, and handle 296. Support member 290 is slidably connected to side plate 230 by guide members 231 and 233. Guide member 231 is generally horizontally-oriented and has a rectangular-loop shape that extends out from side plate 230, through which support member 290 can slide vertically up and down. Guide member 233 has an "L-shape" and extends out from side plate 230. Support member 290 can also slide vertically adjacent to guide member 233, which guides support member 290 along the vertical path. Stops are located at each end of support member 290 to limit the vertical range of motion of support member 290. Arm 292 is pivotally connected to support member 290 and extends in a direction generally toward cogwheel 280. Actuator bar 294 extends vertically down from support member 290. Handle 296 is connected to the end of actuator bar 294 opposite support member 290.

During operation of dispenser 200, it may be desirable to manually actuate dispenser 200 to advance the free end of towel rolls R1 or R2 out of dispenser 200. To do so, a user grasps handle 296 and applies a vertically upward force to handle 296. The force causes actuator bar 294, support member 290, and arm 292 to move in the vertically upward direction until arm 292 engages one of teeth 284. Pivotally connected arm 292 is restrained from pivoting in this direction by a stop member, and therefore arm 292 applies the force to one of teeth 284 of cogwheel 280. Manual actuator 210 continues to move vertically-upward until the force is removed or until guide member 231 comes into contact with a stop of support member 290. Manual actuator 210 then moves in a vertically downward direction. Arm 292 pivots when moved in this direction to slide across teeth 284 without rotating cogwheel 280. The process can be repeated until the desired amount of towel has been dispensed, or until the desired operation of dispenser 200 has been restored.

The design of manual actuator 210 provides a number of benefits. One benefit is that manual actuator 210 can be installed in an existing cabinet 100 with only minimal modification to the cabinet. To install manual actuator 210, only a single hole needs to be drilled or punched in bottom plate 120. Alternatively, a new plate can be installed having the appropriate hole location pre-formed in the plate. Further, the hole can be located in a non-cosmetic location, such as toward the back of bottom plate 120, a location that is not visible during normal use. The manual actuator is easily operated by a user, requiring only the application of a gentle force in an upward direction. The construction is simple and easy for a user to understand and operate.

There is no requirement that manual actuator 210 be included in any arrangement according to the present disclosure. Rather, any manual actuator could also be used, if desired. For example, a motorized dispenser having a hands-free detector could be substituted. This type of actuator is described, for example, in U.S. Pat. Nos. 5,772,291 and 6,105,898, which are incorporated herein by reference. In addition, manual actuator 210 could be located in other locations, such as extending through cabinet door 118. In such a configuration, additional modifications would likely be required to cabinet door 118, such as the cutting of a slot or hole in a cosmetic location of cabinet door 118.

Figure 12:
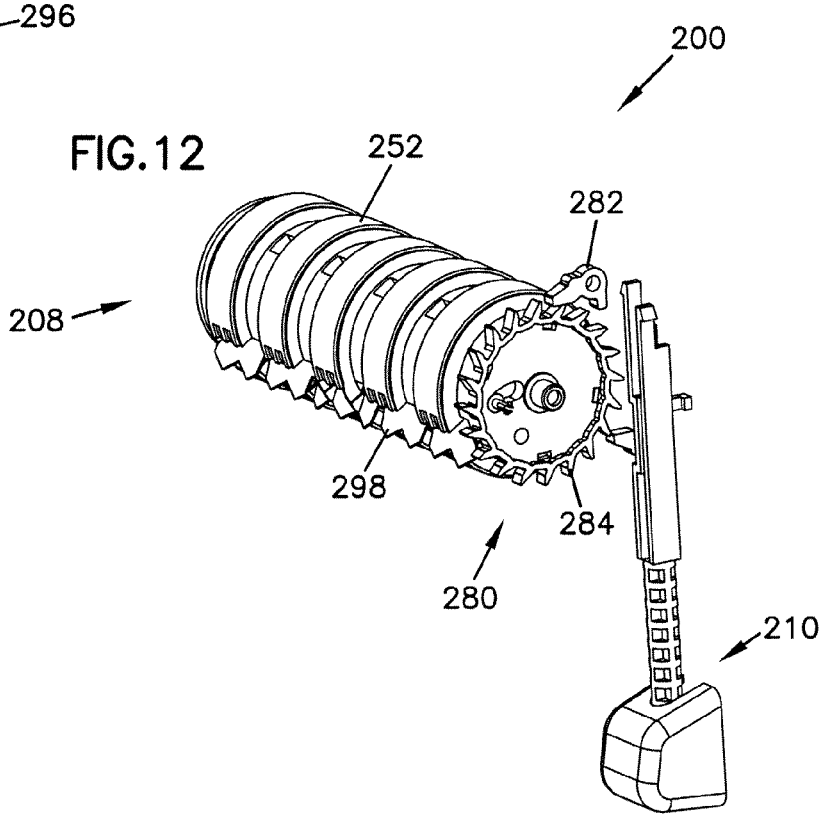
FIG. 12 is a right perspective view illustrating selected parts of the paper towel dispenser of FIG. 1.

FIG. 12 is a perspective view illustrating selected parts of dispenser 200, including dispensing mechanism 208 and manual actuator 210. Dispensing mechanism 208 includes drum 252, cogwheel 280 with teeth 284, and anti-reverse mechanism 282. Drum 252 includes blade 298 that is used by dispensing mechanism 208 to cut towels to the desired length. Blade 298 is recessed within drum 252 until the desired cut location, which occurs once per revolution of drum 252. Once drum 252 has reached the desired cut location, a cam within drum 252 cause blade to extend out from drum 252 and punch through the towel, cutting off the desired length of towel (e.g. T1 or T2 discussed above). Alternatively, biasing members such as springs could also be used to extend and retract blade 298.

Therefore, it can be seen that the paper towel dispenser of the present disclosure provides multiple benefits over prior systems. The dispenser is configured for installation within a recessed cabinet without requiring that major modifications be made to the existing cabinet, saving both installation time and cost.

The above specification, examples and data provide a complete description of the manufacture and use of the composition of the invention. It is noted that not all of the features characterized herein need to be incorporated within a given arrangement, for the arrangement to include improvements according to the present disclosure.

What is claimed is:

1. A paper towel dispenser adapted for use in a cabinet that is recessed within a wall, the wall having a planar exposed surface, the cabinet defining a cavity configured to hold paper products, the cabinet having a door that, when closed, is substantially coplanar with the planar exposed surface of the wall, the dispenser comprising:

a frame;

a first paper roll support supported by the frame and configured to mount a first roll of paper towel;

a dispensing mechanism configured to engage a free end of the first roll of paper towel to advance the paper towel out of the cabinet, wherein the dispenser is configured to fit within the cabinet when the cabinet door is closed; and a manual actuator having an actuator bar that extends downward from and out of the dispenser, the manual actuator being configured to advance the paper towel through the dispensing mechanism upon the application of an upward force to the actuator bar.

2. The paper towel dispenser of claim 1, further comprising a second paper roll support supported by the frame configured to mount a second roll of paper towel.

3. The paper towel dispenser of claim 2, wherein the first paper roll support comprises a first pair of roll supports, each supported by opposite sides of the frame to support the first roll of paper towel, and wherein the second paper roll support comprises a second pair of roll supports, each supported by opposite sides of the frame to support the second roll of paper towel.

4. The paper towel dispenser of claim 2, further comprising a transfer mechanism configured to engage a free end of the second roll of paper towel and deliver the free end of the second roll of paper towel to the dispensing mechanism after the first roll of paper towel has been dispensed from the first roll of paper towel.

5. The paper towel dispenser of claim 1, the dispensing mechanism further comprising:

a drum; and a cogwheel rigidly connected to the drum, the cogwheel having a plurality of teeth.

6. The paper towel dispenser of claim 5, the dispensing mechanism further comprising a pinch roller adjacent to the drum and configured to engage paper towel between the pinch roller and the drum.

7. The paper towel dispenser of claim 5, the manual actuator further comprising an arm configured to engage with one of the teeth of the cogwheel to rotate the cogwheel and the drum of the dispensing mechanism.

8. A method of dispensing paper toweling from a paper towel dispenser adapted for use within a wall having a planar exposed surface, the cabinet having an upper cabinet defining a cavity for holding paper products, the upper cabinet having a door that, when closed, is substantially coplanar with the planar exposed surface of the wall and that encloses the paper towel dispenser within the cavity, the method comprising:

actuating a dispensing mechanism to advance a free end of the paper toweling out from the upper cabinet upon the application of an upward force to an actuator located beneath the paper towel dispenser;

cutting a length of the paper toweling; and removing the length of paper toweling from the dispenser.

9. The method of claim 8, wherein actuating a dispensing mechanism comprises applying a force to the free end of the paper toweling.

10. The method of claim 8, wherein the actuator is a manual actuator that extends vertically downward from and out of the paper towel dispenser.

11. The method of claim 8, further comprising:

dispensing all paper toweling from a first roll of paper toweling;

transferring a free end of paper toweling from a second roll of paper toweling to the dispensing mechanism; and dispensing paper toweling from the second roll of paper toweling.

12. A paper towel dispenser, comprising:

a back frame defining a vertical orientation;

first and second side plates connected to the back frame, the first and second side plates defining tracks;

first and second pairs of paper roll supports supported by the first and second side plates and configured to mount rolled paper towel having a central axis of rotation in a horizontal orientation;

a dispensing mechanism supported by the frame, the dispensing mechanism configured to engage the paper towel and advance the paper towel through the dispensing mechanism;

a manual actuator operable from vertically below the dispensing mechanism to actuate the dispensing mechanism to advance the paper towel; and a transfer mechanism engaged with the tracks of the first and second side plates, the transfer mechanism being configured to engage paper towel mounted to the second pair of paper roll supports;

wherein the tracks of the first and second side plates are vertically oriented to direct the transfer mechanism down toward the dispensing mechanism.

13. The paper towel dispenser of claim 12, wherein the second pair of paper roll supports is supported by the frame vertically above the first pair of paper roll supports.

14. The paper towel dispenser of claim 13, wherein the transfer mechanism is oriented substantially within a horizontal plane, the transfer mechanism comprising:

a towel engagement member having a central portion, the towel engagement member being configured to engage the paper towel mounted to the second pair of paper roll supports;

a rear member having a central portion; and a cross member connected between the central portion of the towel engagement member and the central portion of the rear member.

15. The paper towel dispenser of claim 14, wherein the tracks include a first track defined by the first side plate, a second track defined by the second side plate, and a third track defined by the second side plate, and wherein the first track is connected to one end of the rear member, the second track is connected to one end of the rear member opposite the first track, and the third track is connected to one end of the towel engagement member, the first, second, and third tracks all being vertically oriented to direct the transfer mechanism down toward the dispensing mechanism.

16. The paper towel dispenser of claim 15, wherein lengths of the first and second tracks are less than a length of the third track.

17. The paper towel dispenser of claim 15, wherein the third track includes a curved portion at a height below a bottom of the first and second tracks that causes the transfer mechanism to rotate such that the towel engagement member of the transfer bar is lower than the rear member of the transfer bar.

18. A method of installing a paper towel dispenser within a cabinet recessed within a wall, the wall having a planar exposed surface, the cabinet defining a cavity for holding paper towel, the cabinet having a cabinet door that, when placed in a closed position, is substantially coplanar with the planar exposed surface of the wall, the method comprising:

opening the cabinet door of the cabinet into a position such that the cabinet door extends out from the planar exposed surface of the wall;

providing a bottom plate defining a hole sized to have a manual actuator pass there through;

inserting the paper towel dispenser within the cabinet after opening the cabinet door;

extending a manual actuator through the hole in the bottom plate;

installing paper toweling in the paper towel dispenser, including:

sliding a transfer bar of the paper towel dispenser within vertical slots defined by the dispenser to a position above a first pair of roll supports;

inserting a first roll of paper towel between the first pair of roll supports; and inserting a second roll of paper towel between a second pair of roll supports; and closing the cabinet door of the cabinet after inserting the paper towel dispenser to return the cabinet door to a position substantially coplanar with the planar exposed surface of the wall.

19. The method of claim 18, wherein the bottom plate is an existing bottom plate of the cabinet, and wherein the step of providing the plate further comprises forming the hole through the existing bottom plate of the cabinet.

20. The method of claim 18, wherein installing paper toweling comprises:

inserting a free end of the first roll of paper towel into a dispensing mechanism of the paper towel dispenser after inserting the first roll of paper towel; and resting the transfer bar on top of the first roll of paper towel after inserting the first roll of paper towel.

21. The method of claim 20, wherein installing paper toweling further comprises connecting a free end of the second roll of paper towel to the transfer bar.

22. A paper towel dispenser, comprising:

a frame including a first paper roll support to which a first paper roll mounts;

a dispensing mechanism that engages a free end of a first paper roll mounted to the first paper roll support, the dispensing mechanism being constructed to advance paper from the first paper roll out of the dispenser; and a manual actuator having an actuator bar that extends downward from and out of the dispenser, the manual actuator being configured to advance the paper out of the dispenser upon the application of an upward force to the actuator bar.

23. The paper towel dispenser of claim 22, wherein the frame includes a second paper roll support to which a second paper roll mounts.

24. The paper towel dispenser of claim 23, further comprising a transfer mechanism that engages a free end of a second paper roll mounted to the second paper roll support, the transfer mechanism delivering the free end of the second paper roll to the dispensing mechanism after the first paper roll has been depleted.

25. The paper towel dispenser of claim 24, wherein the transfer mechanism slides within vertical slots formed in the frame.

26. The paper towel dispenser of claim 22, wherein the frame of the paper towel dispenser is sized for use in a cabinet that is recessed within a wall, the wall having a planar exposed surface, the cabinet defining a cavity configured to hold paper products, the cabinet having a door that, when closed, is substantially coplanar with the planar exposed surface of the wall.

* * * * *